US010100839B2

(12) United States Patent
Kasahara et al.

(10) Patent No.: US 10,100,839 B2
(45) Date of Patent: Oct. 16, 2018

(54) CENTRIFUGAL FAN

(71) Applicant: KEIHIN CORPORATION, Shinjuku-ku, Tokyo (JP)

(72) Inventors: Masamichi Kasahara, Utsunomiya (JP); Masaaki Ishizaki, Watari-gun (JP)

(73) Assignee: KEIHIN CORPORATION, Tokyo (JP)

( * ) Notice: Subject to any disclaimer, the term of this patent is extended or adjusted under 35 U.S.C. 154(b) by 310 days.

(21) Appl. No.: 15/033,340

(22) PCT Filed: Dec. 10, 2014

(86) PCT No.: PCT/JP2014/082670
§ 371 (c)(1),
(2) Date: Apr. 29, 2016

(87) PCT Pub. No.: WO2015/087909
PCT Pub. Date: Jun. 18, 2015

(65) Prior Publication Data
US 2016/0290353 A1 Oct. 6, 2016

(30) Foreign Application Priority Data
Dec. 11, 2013 (JP) ..... 2013-256328

(51) Int. Cl.
*F04D 29/28* (2006.01)
*F04D 29/30* (2006.01)
*F04D 29/66* (2006.01)

(52) U.S. Cl.
CPC ..... *F04D 29/281* (2013.01); *F04D 29/283* (2013.01); *F04D 29/30* (2013.01);
(Continued)

(58) Field of Classification Search
CPC ..... F04D 1/04; F04D 29/281; F04D 29/283; F04D 29/30; F04D 29/668; F05D 2260/96; Y10S 416/02
See application file for complete search history.

(56) References Cited

U.S. PATENT DOCUMENTS 5,064,346 A * 11/1991 Atarashi ..... F01D 5/141 416/178
5,564,495 A * 10/1996 Yoshihashi ..... F24F 1/0007 165/122

(Continued)

FOREIGN PATENT DOCUMENTS

JP 52080104 A 6/1977
JP 07127599 A 5/1995

(Continued)

OTHER PUBLICATIONS

International Search Report corresponding to Application No. PCT/JP2014/082670; dated Mar. 17, 2015, with English translation.

*Primary Examiner* — Igor Kershteyn
(74) *Attorney, Agent, or Firm* — Cantor Colburn LLP

(57) ABSTRACT

Each of blades of a centrifugal fan includes a primary wing section that has a trailing edge which is parallel to a central axis of rotation, a leading edge end section which is parallel to the central axis of rotation, and a thickness gradually growing thinner toward the trailing edge and the leading edge end section; and an auxiliary wing section that extends from the leading edge end section of the primary wing section toward the interior of the centrifugal fan. The auxiliary wing section has a length from the leading edge end section of the primary wing section to the leading edge of the auxiliary wing section that is greater at a side of a support section than at an intake side when viewed in a direction of the central axis of rotation, and a constant thickness across the entire area of the auxiliary wing section.

9 Claims, 8 Drawing Sheets

(52) U.S. Cl.
CPC ..... *F04D 29/668* (2013.01); *F05D 2260/96* (2013.01); *Y10S 416/02* (2013.01)

(56) References Cited

U.S. PATENT DOCUMENTS

| | | | | |
|---|---|---|---|---|
| 7,281,898 | B2 * | 10/2007 | Baek | F04D 29/282 415/206 |
| 7,422,418 | B2 * | 9/2008 | Ishijima | F04D 29/283 415/119 |
| 7,618,239 | B2 * | 11/2009 | Hatsugai | F04D 29/666 416/185 |
| 8,011,891 | B2 * | 9/2011 | Ochiai | F04D 29/282 416/188 |
| 8,225,623 | B2 * | 7/2012 | Ikeda | F04D 29/281 62/419 |
| 8,870,541 | B2 * | 10/2014 | Imahigashi | F04D 29/30 416/187 |
| 2003/0053911 | A1 | 3/2003 | Sakai et al. | |
| 2004/0076516 | A1 * | 4/2004 | Bird | F04D 29/30 415/206 |
| 2007/0253834 | A1 | 11/2007 | Ogino et al. | |
| 2009/0162198 | A1 * | 6/2009 | Ogino | F04D 29/282 416/9 |

FOREIGN PATENT DOCUMENTS

| | | | |
|---|---|---|---|
| JP | 2003090298 | A | 3/2003 |
| JP | 2006077723 | A | 3/2006 |
| JP | 2010106708 | A | 5/2010 |

* cited by examiner

CENTRIFUGAL FAN

This is the U.S. national stage of application No. PCT/JP2014/082670, filed on Dec. 10, 2014. Priority under 35 U.S.C. § 119(a) and 35 U.S.C. § 365(b) is claimed from Japanese Application No. 2013-256328, filed Dec. 11, 2013, the disclosure of which is also incorporated herein by reference.

TECHNICAL FIELD

The present invention relates to a centrifugal fan which suctions air in one direction of a central axis of rotation and radially discharges the air.

Priority is claimed on Japanese Patent application No. 2013-256328, filed Dec. 11, 2013, the content of which is incorporated herein by reference.

BACKGROUND ART

Patent Literature 1 discloses a centrifugal multi-blade blower fan. Such a centrifugal multi-blade blower fan is generally referred to as a centrifugal fan and includes a boss plate of a circular shape viewed from the front in which a cylindrical support section is provided at a center and a plurality of blades are provided at regular intervals at an outer circumference of the boss plate in the circumferential direction as shown in FIGS. 1 and 2 of Patent Literature 1. The blades have shapes extending in parallel with each other in a direction of a central axis of rotation of the boss plate. Also, a leading edge (an inner circumferential edge) and a trailing edge (an outer circumferential edge) of each of the blades are both in parallel with the central axis of rotation. In such a centrifugal multi-blade blower fan, a rotation shaft of a motor is mounted on the cylindrical support section and is rotatably driven so that external air is suctioned in one direction in the direction of the central axis of rotation and is discharged in a radial direction of the boss plate.

CITATION LIST

Patent Literature

[Patent Literature 1]
Japanese Unexamined Patent Application, First Publication No. H07-127599

SUMMARY OF INVENTION

Technical Problem

However, the above-described centrifugal fan (the centrifugal multi-blade blower fan) is generally used for a blower (a centrifugal blower) configured to send a fluid such as air. Improvement of air blowing efficiency defined as a ratio of mechanical energy applied to a fluid using blades and driving power of a rotation shaft is an important technical issue in a blower. Air blowing efficiency is mainly determined by a mechanical shape of a centrifugal fan as is well known.

Reduction of operational sound (noise) is also an important technical issue in a centrifugal fan. This operational sound is mainly determined by the mechanical shape of the centrifugal fan as in the air blowing efficiency. Improvement of air blowing efficiency and reduction of operational sound are important technical issues in a design of a centrifugal fan.

The present invention was made in view of the above-described circumstances, and an object of the present invention is to provide a centrifugal fan in which air blowing efficiency can be improved while an increase of operational sound is suppressed.

Solution to Problem

In order to accomplish the object for the purpose of solving the above technical problems, the present invention adopts the following aspects.

(A) According to a first embodiment of the present invention, there is provided a centrifugal fan in which a rotation shaft is attached to a mounting section to rotate in a predetermined direction so that air taken in from a front of a support section is blown out radially, the centrifugal fan including: the support section having a circular shape viewed from the front; a plurality of blades arranged in an annular shape along an outer circumference of the support section; and the mounting section provided at a center of the support section, wherein each of the blades includes: a primary wing section that has a trailing edge which is parallel to a central axis of rotation of the rotation shaft, a leading edge end section which is parallel to the central axis of rotation, and a thickness gradually growing thinner toward the trailing edge and the leading edge end section; and an auxiliary wing section that extends from the leading edge end section of the primary wing section toward the interior of the centrifugal fan, and wherein the auxiliary wing section has a length from the leading edge end section of the primary wing section to a leading edge of the auxiliary wing section that is greater at a side of the support section than at an intake side when viewed in a direction of the central axis of rotation, and wherein the auxiliary wing section has a constant thickness across the entire area of the auxiliary wing section.

(B) In the aspect of (A), a pressure surface of the auxiliary wing section and a pressure surface of the primary wing section may be smoothly connected to each other.

(C) In the aspect of (B), the auxiliary wing section may extend in a tangential direction at a position of the leading edge end section on the pressure surface of the primary wing section.

(D) In the aspect of any one of (A) to (C), the auxiliary wing section when viewed from the front may be linearly formed from the leading edge end section of the primary wing section to the leading edge of the auxiliary wing section.

(E) In the aspect of any one of (A) to (D), the leading edge of the auxiliary wing section when viewed from the side may have a linear shape from the intake side in the direction of the central axis of rotation toward the side of the support section.

(F) In the case of (E), a constitution in which D1/D2 which is a ratio obtained by dividing an intake-side leading edge diameter D1 which is defined by the leading edge at the linear portion of each of the blades and is a diameter at the position of the intake side in the direction of the central axis of rotation by a trailing edge diameter D2 which is a diameter defined by the trailing edge of each of the blades satisfies the following relational equation (1), and D1'/D2 which is a ratio obtained by dividing a support section-side leading edge diameter D1' which is defined by the leading edge at the linear portion of each of the blades and is a diameter at a position of the side of the support section in the direction of the central axis of rotation by the trailing edge diameter D2 satisfies the following relational equation (2) may be adopted:

$$0.75 \leq D1/D2 \leq 0.90 \quad (1) \text{ and}$$

$$0.65 \leq D1'/D2 \leq 0.75 \quad (2)$$

(G) In the aspect of any one of (A) to (F), a constitution in which an angle formed by a tangent at the leading edge end section of an inscribed circle of the leading edge end section and a tangent at the leading edge end section of the pressure surface of the primary wing section is 65° or more and 75° or less; and an angle formed by a tangent at the trailing edge of the a circumscribed circle of the trailing edge and a tangent at the trailing edge of the pressure surface of the primary wing section is 0° or more and 15° or less may be adopted.

(H) In the aspect of any one of (A) to (D), the leading edge of the auxiliary wing section when viewed from the side may have a curved shape from the intake side in the direction of the central axis of rotation toward the support section.

(I) In the aspect of any one of (A) to (H), the centrifugal fan may further include an annular shroud configured to fix the trailing edges of the blades at tip sides of the blades.

Advantageous Effects of Invention

According to the centrifugal fan of the aspect described in (A), since a length from the leading edge end section of the primary wing section to the leading edge of the auxiliary wing section is extended from the intake side in the direction of the central axis of rotation toward the support section, a wing length of the auxiliary wing section at a downstream side (a side of a support section) of a main stream of a flow can be extended while inflow resistance of the intake side is reduced. Thus, air blowing efficiency can be improved.

In other words, since the leading edge of the auxiliary wing section is inclined from an upstream side in a suction direction of air toward a downstream side, a way of applying mechanical energy applied to the air to suction the air can be gradually increased from the upstream side toward the downstream. Thus, noise according to separation or disturbance of the air can be suppressed compared with a structure for abruptly applying large mechanical energy to the air from the upstream side as in related art. Therefore, according to the centrifugal fan, air blowing efficiency can be improved compared with the related art while operational sound (noise) is suppressed.

Since the thickness of the auxiliary wing section is constant, resistance when the air flows in the leading edge of the blade can be reduced while the thickness of the downstream side (the side of the support section) in which the wing length of the auxiliary wing section is long is prevented from being excessively thicker at the side of the primary wing section. To describe this, for example, when the shape of the auxiliary wing section is tapered toward the leading edge, the thickness of the leading edge should not be made thinner in consideration of the tapered shape formed through injection molding using a mold. For this reason, the thickness of the auxiliary wing section of the side of the primary wing section is increased relative to the leading edge to acquire the tapered shape, but the thickness of the downstream side (the side of the support section) in which the wing length of the auxiliary wing section is particularly long may become excessively thick at the side of the primary wing section of the auxiliary wing section. For this reason, the thickness of the auxiliary wing section needs to be constant.

By giving the auxiliary wing section that is thinner relative to the primary wing section a constant thickness, a simple shape when viewed in the direction of the central axis of rotation can be acquired. Thus, a mold is easily manufactured and it can also contribute to lower costs.

In the case of (B), since a step difference or a bent section is not formed between the pressure surface of the auxiliary wing section and the pressure surface of the primary wing section, an air flow sent from the auxiliary wing section toward the primary wing section flows smoothly. Thus, air blowing efficiency and noise reduction can be further improved.

In the case of (C), since the auxiliary wing section extends in the tangential direction of the pressure surface of the primary wing section so that the pressure surface of the auxiliary wing section and the pressure surface of the primary wing section can be smoothly connected to each other, the operational sound (noise) can be further suppressed without generating disturbance of the flow at the connected portion.

In the case of (D), the auxiliary wing section having a small thickness and arranged more densely than the side of the trailing edge of the primary wing section is linearly formed so that a mold is more easily manufactured than when formed in a curved shape and it can contribute to lower costs.

In the case of (E), the auxiliary wing section having a small thickness and arranged more densely than the side of the trailing edge of the primary wing section is linearly formed so that a mold is more easily manufactured than when formed in a curved shape and it can contribute to lower costs.

In the case of (F), the air blowing efficiency can be improved to a greater level while the operational sound (noise) is suppressed to a lesser level.

In the case of (G), occurrence of vortexes or occurrence of separation of the air from the surfaces of the blades in the air flowing between the blades can be suppressed to the minimum. Thus, noise caused by the vortexes or the separation of the air from the blades can be reduced. Energy loss caused by the vortexes or the separation of the air from the blades can also be suppressed to the minimum to improve the air blowing efficiency.

In the case of (H), the leading edge of the auxiliary wing section is formed in a concave or convex curved shape viewed from the side so that it is possible to flexibly cope with an acquired specification of the centrifugal fan.

In the case of (I), the shroud itself can connect the blades to each other to reinforce a support state of the blades and define an inflow area (a flow path) of the air flowing in.

DESCRIPTION OF EMBODIMENTS

Hereinafter, an embodiment of the present invention and modified examples thereof will be described with reference to the drawings.

Figure 1A:
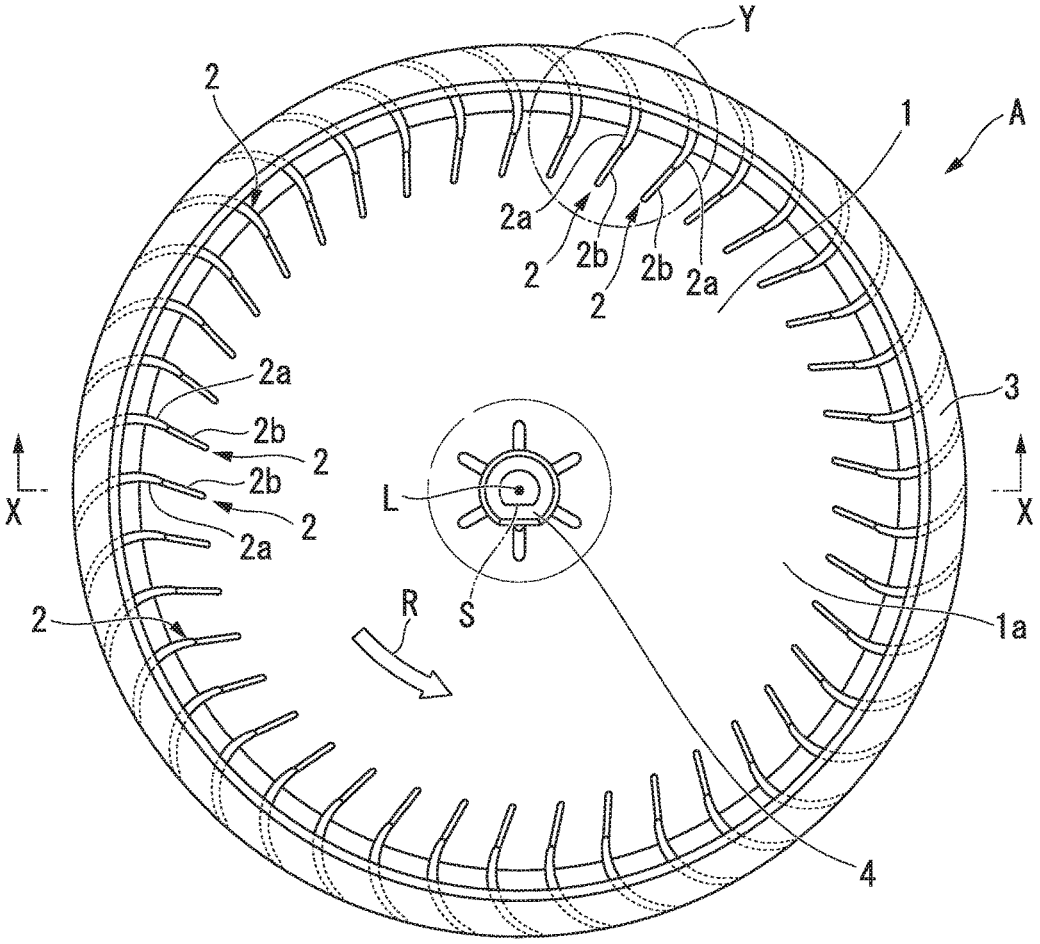
FIG. 1A is a front view of a centrifugal fan A according to an embodiment of the present invention.
Figure 1B:
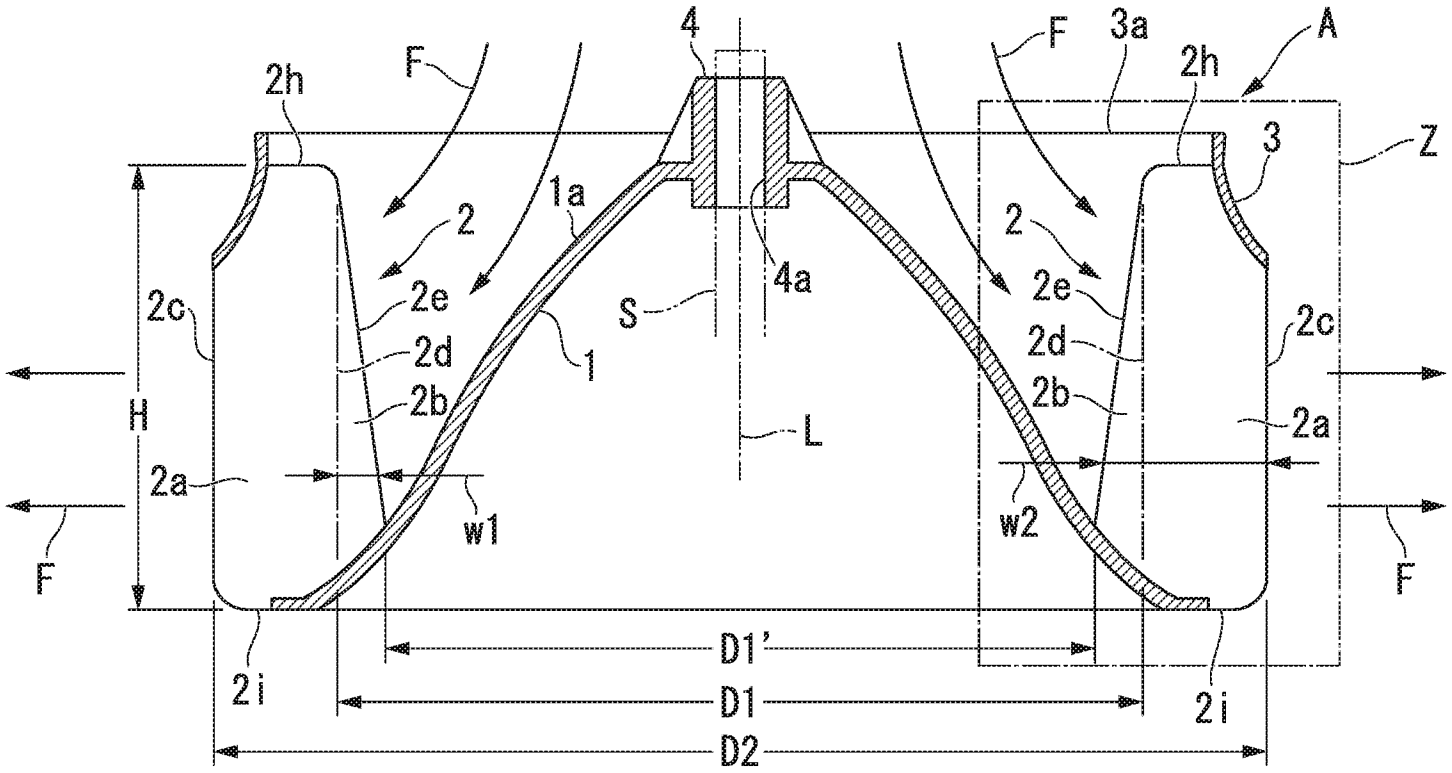
FIG. 1B is a cross-sectional view taken along line X-X of FIG. 1A, showing a view of the centrifugal fan A.

As shown in FIGS. 1A and 1B, a centrifugal fan A according to the embodiment is a rotating body having a substantially cylindrical appearance and configured to rotate about a central axis of rotation L (a central axis of a rotation shaft S of a motor (not shown)) counterclockwise. As indicated by an arrow R in FIG. 1A, the centrifugal fan A rotates counterclockwise to suction air F from above (an intake inlet) and radially discharge it in an outer circumferential direction (a direction substantially perpendicular to the central axis of rotation L).

The centrifugal fan A includes a support section 1, a plurality of blades 2, a shroud 3, and a mounting section 4 as main constituent elements and is a resin molded product formed using a mold using, for example, polypropylene as a raw material.

The support section 1 has a circular shape viewed from the front as shown in FIG. 1A and is a substantially conical shape (a dome shape) whose longitudinal cross-sectional shape gradually extends backward from above (the intake inlet) in the drawing from a center (the central axis of rotation L) toward an outer circumference as shown in FIG. 1B. As shown in FIG. 1B, the support section 1 of such a shape supports the plurality of blades 2 and guides the air F suctioned from above (the intake inlet) in an outer circumferential direction. In other words, when the centrifugal fan A rotates in an arrow R direction of FIG. 1A, the air F is taken in substantially in parallel with the central axis of rotation L, a flow direction of the air F is bent along an inclined surface (a guide surface 1*a* to be described below) of the support section 1, and the air is discharged outside of the centrifugal fan A in the outer circumferential direction as shown in FIG. 1B.

An upper surface (a surface) configured to suction the air F in the support section 1 is the guide surface 1*a* configured to guide the air F. As shown in FIG. 1B, the guide surface 1*a* is a dome shape which gradually extends backward away from the central axis of rotation L (an angle of inclination is steep). On the other hand, a rear surface of the guide surface 1*a* of the support section 1 is a recessed surface.

The blades 2 are provided at regular intervals along an outer circumference of the support section 1 when viewed from the front shown in FIG. 1A and are long elements extending in a direction in parallel with the central axis of rotation L when viewed in a cross section shown in FIG. 1B. In other words, the blades 2 are arranged in an annular shape at regular angular intervals at positions a constant distance away from the central axis of rotation L in a radial direction. The number of blades 2 is, for example, 41 in the embodiment shown in FIG. 1A.

Figure 2:
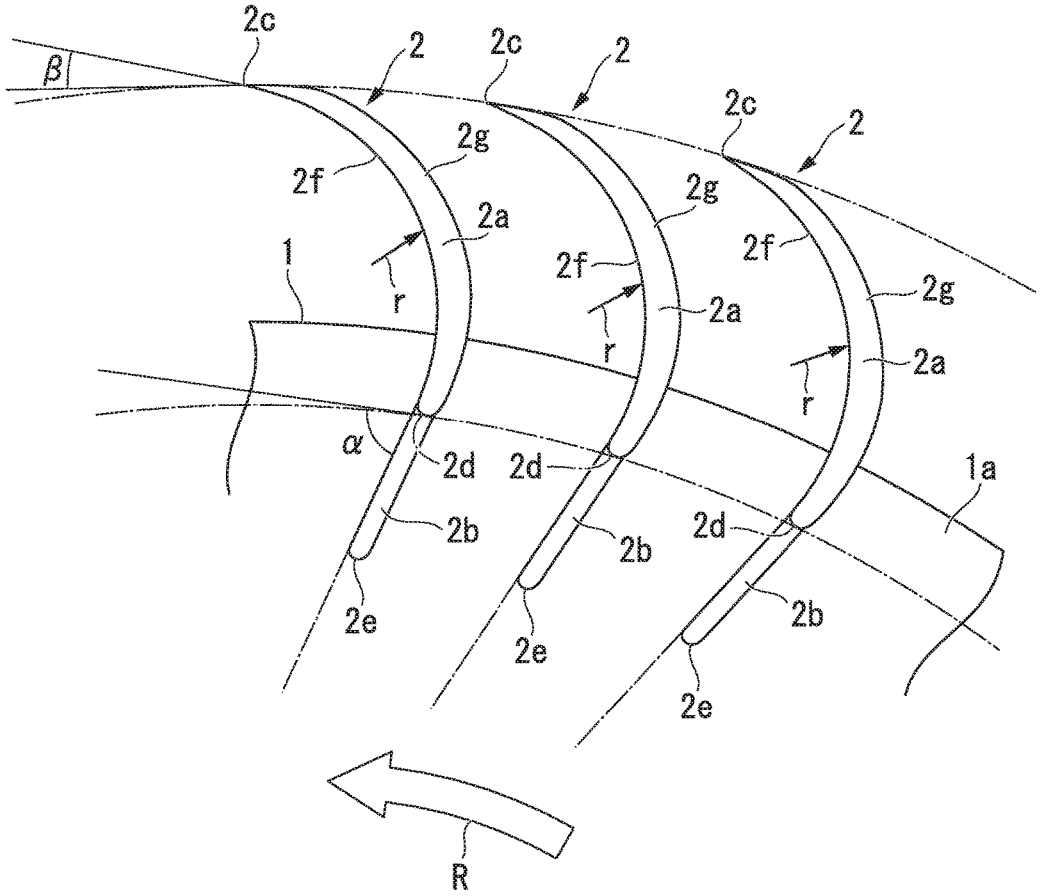
FIG. 2 is an enlarged view of a portion Y of FIG. 1A, showing a view of blades 2 of the centrifugal fan A.

As shown in FIGS. 1A to 2, each of the blades 2 includes two portions, i.e., a primary wing section 2*a* and an auxiliary wing section 2*b*. The primary wing section 2*a* includes a trailing edge 2*c* which is parallel to the central axis of rotation L and a leading edge end section 2*d* which is similarly parallel to the central axis of rotation L.

The primary wing section 2*a* has a thickness which gradually grows thinner toward the trailing edge 2*c* and the leading edge end section 2*d* and a shape which is gently curved as a whole to protrude in a direction opposite to a rotation direction. In other words, the primary wing section 2*a* has a front shape (a cross-sectional shape) where an intermediate part between the trailing edge 2*c* and the leading edge end section 2*d* which are parallel to each other gradually becomes thicker than the trailing edge 2*c* and the leading edge end section 2*d* as farther from the trailing edge 2*c* and the leading edge end section 2*d*.

On the other hand, the auxiliary wing section 2*b* extends from the leading edge end section 2*d* of the primary wing section 2*a* toward the interior of the centrifugal fan A. In other words, the auxiliary wing section 2*b* is connected to the above-described leading edge end section 2*d* of the primary wing section 2*a* and extends in a tangential direction on a surface of a rotation direction side of the primary wing section 2*a*. To be more specific, the auxiliary wing section 2*b* linearly extends in the tangential direction at a position of the leading edge end section 2*d* on a pressure surface 2*f* which is the surface of the rotation direction side of the primary wing section 2*a* on a surface perpendicular to the central axis of rotation L as indicated by the dashed-dotted line in FIG. 2. Note that, in the primary wing section 2*a*, the above-described surface of the rotation direction side is a curved surface having constant curvature r as a whole.

The auxiliary wing section 2*b* includes a leading edge 2*e* inclined with respect to the central axis of rotation L such that a downstream side (a lower side in FIG. 1B) of the air F is closer to the central axis of rotation L than an upstream side (an upper side in FIG. 1B) and has a thickness which is constant as a whole. In other words, the auxiliary wing section 2*b* has a length from the leading edge end section 2*d* of the primary wing section 2*a* to the leading edge 2*e* of the auxiliary wing section 2*b* that is greater at a side of the support section 1 than at an intake side and a constant thickness across the entire area of the auxiliary wing section 2*b* when viewed in a direction of the central axis of rotation L. To be more specific, the auxiliary wing section 2*b* has a shape in which a width w1 in a direction perpendicular to the central axis of rotation L (a radial direction) toward a suction direction of the air F (downward in the drawing) gradually spreads as shown in FIG. 1B. Note that the leading edge 2*e* has a linear shape as shown FIG. 1B.

The surface of the rotation direction side of the primary wing section 2*a* and the auxiliary wing section 2*b* in each of the blades 2 is the pressure surface 2*f* whose pressure is greater than normal pressure when the centrifugal fan A rotates counterclockwise, while a surface opposite to the rotation direction is a suction surface 2*g* whose pressure is lower than the normal pressure. As shown in FIG. 2, the pressure surface 2*f* of the auxiliary wing section 2*b* and the pressure surface 2*f* of the primary wing section 2*a* are smoothly connected to each other. The auxiliary wing section 2*b* extends in the tangential direction at the position of the leading edge end section 2*d* on the pressure surface 2*f* of the primary wing section 2*a*. To be more specific, the auxiliary wing section 2*b* when viewed from the front is linearly formed from the leading edge end section 2*d* of the primary wing section 2*a* to the leading edge 2*e* of the auxiliary wing section 2*b*. The leading edge 2*e* of the auxiliary wing section 2*b* when viewed from the side as shown in FIG. 1B has a linear shape from the intake side in the direction of the central axis of rotation L toward the support section 1.

As shown in FIG. 1B, an end of the primary wing section 2*a* of the intake side of the air F (the upper side in the drawing) in each of the blades 2 is a blade tip 2*h* perpendicular to the central axis of rotation L, while an end of the primary wing section 2*a* of a discharge side of the air F (the lower side in the drawing) is a blade rear end 2*i* similarly perpendicular to the central axis of rotation L.

Each of the blades 2 including the primary wing section 2*a* and the auxiliary wing section 2*b* will be described in greater detail.

First, a ratio (D1/D2) of a diameter defined by the leading edge 2*e* at a side of the blade tip 2*h* of each of the blades 2 (a tip leading edge diameter D1) and a diameter defined by the trailing edge 2*c* of each of the blades 2 (a trailing edge diameter D2) satisfies the following relational equation (3). In other words, D1/D2 which is a ratio obtained by dividing the intake-side leading edge diameter D1 which is defined by the leading edge 2*e* at a linear portion of each of the blades 2 and is a diameter at the position of the intake side in the direction of the central axis of rotation L by the trailing edge diameter D2 which is the diameter defined by the trailing edge 2*c* of each of the blades 2 satisfies the following relational equation (3). To be more specific, numerical values obtained by dividing a diameter at a position at which a distance dimension from the central axis of rotation L to the leading edge 2*e* is maximized (the tip leading edge diameter D1) by the diameter defined by the trailing edge 2*c* of the primary wing section 2*a* (the trailing edge diameter D2) are in a range of 0.75 to 0.90. Note that this range is more preferably 0.79 to 0.81 and most preferably 0.80.

$$0.75 \leq D1/D2 \leq 0.90 \quad (3)$$

Also, D1'/D2 which is a ratio obtained by dividing a support section-side leading edge diameter D1' which is defined by the leading edge 2*e* at the linear portion of each of the blades 2 and is a diameter at a position of the side of the support section 1 in the direction of the central axis of rotation L by the trailing edge diameter D2 satisfies the following relational equation (4). In other words, a ratio (D1'/D2) of a diameter defined by the leading edge 2*e* at a side of the blade rear end 2*i* of each of the blades 2 (a rear end leading edge diameter D1') and the trailing edge diameter D2 satisfies the following relational equation (4). To be more specific, numerical values obtained by dividing a diameter at a position at which the distance dimension from the central axis of rotation L to the leading edge 2*e* is minimized (the tip leading edge diameter D1') by the trailing edge diameter D2 are in a range of 0.65 to 0.75. Note that this range is more preferably 0.69 to 0.72 and most preferably 0.71.

$$0.65 \leq D1'/D2 \leq 0.75 \quad (4)$$

Note that H/D2 which is a ratio obtained by dividing a length in parallel with the direction of the central axis of rotation L of each of the blades 2 (a wing length H) by the trailing edge diameter D2 is, for example, 0.4 to 0.5.

As shown in FIG. 2, an angle formed by a tangent at the leading edge end section 2*d* of an inscribed circle of the leading edge end section 2*d* and a tangent at the above-described leading edge end section 2*d* of the surface of the rotation direction side of the primary wing section 2*a*, i.e., an inlet angle α in each of the above-described blades 2 is an angle of 65° or more and 75° or less and more preferably 70°. In other words, the inlet angle α which is an angle formed by the inscribed circle coming into contact with the leading edge end section 2*d* with respect to the central axis of rotation L and the tangent at the position of the leading edge end section 2*d* of the pressure surface 2*f* of the primary wing section 2*a* is in a range of 65° to 75°, and this range is more preferably 70°.

As shown in FIG. 2, an angle formed by a tangent at the trailing edge 2*c* of a circumscribed circle of the trailing edge 2*c* and a tangent at the trailing edge 2*c* of the surface of the rotation direction side of the primary wing section 2*a*, i.e., an exit angle β in each of the above-described blades 2, is an angle of 0° or more and 15° or less, and more preferably 10°. In other words, the exit angle β which is an angle formed by the circumscribed circle of the trailing edge 2*c* and the tangent at the trailing edge 2*c* of the pressure surface 2*f* of the primary wing section 2*a* is in a range of 0° to 15°, and this range is more preferably 10°.

As shown in FIG. 2, the trailing edge 2*c* has a pointed shape, i.e., a shape in which the pressure surface 2*f* comes into contact with the suction surface 2*g* at an acute angle when the centrifugal fan A is viewed from the front. On the other hand, the leading edge 2*e* is formed in a rounded shape, i.e., a shape in which the pressure surface 2*f* is connected to the suction surface 2*g* in a circular arc shape when the centrifugal fan A is viewed from the front as shown in FIG. 2.

As shown in FIGS. 1A and 1B, a shroud 3 is connected to upper ends (tips) of the blades 2 arranged in the annular shape and has an annular shape that is slightly narrowed upward. The shroud 3 itself connects the upper ends (the tips) of the blades 2 to each other to reinforce a support state of the blades 2 connected to the support section 1 and define an inflow area (a flow path) of the air F flowing in from above in FIG. 1B. In other words, the shroud 3 has a shape in which the inflow area of the air F is slightly narrowed compared with a circular area defined by the trailing edge diameter D2. An upper end 3*a* of the shroud 3 is located above the blade tips 2*h* of the blades 2 as shown in FIG. 1B.

The mounting section 4 is provided at the center of the support section 1 and is a portion for mounting the rotation shaft S of a driving apparatus (not shown) (e.g., a motor) configured to rotatably drive the centrifugal fan A. A mounting hole 4*a* used to insert the rotation shaft S is formed in the mounting section 4. The mounting section 4 protrudes upward from the upper end 3*a* of the shroud 3 as shown in FIG. 1B. In other words, the mounting section 4 protrudes upward from the blade tips 2*h* of the blades 2.

Next, effects of the centrifugal fan A with such a constitution will be described in detail also with reference to FIGS. 3A to 3E.

In the centrifugal fan A, the plurality of blades 2 arranged in the annular shape with a constant radius from the central axis of rotation L rotate counterclockwise so that the air F at the upper side in the drawing of the central axis of rotation L shown in FIG. 1B is suctioned and is blown out radially in the outer circumferential direction. In other words, the centrifugal fan A rotates about the central axis of rotation L so that the air at the upper side in the drawing is suctioned, a flow is formed, the air is fluidized, the air F passes through the inflow area (the flow path), the air is deflected, and the air is discharged in the outer circumferential direction.

The centrifugal fan A of the embodiment includes the auxiliary wing section 2*b* of the shape in which the width of each of the blades 2 gradually spreads toward an opposite side (a lower side) to the suction direction of the air F in addition to the primary wing section 2*a*. In other words, in each of the blades 2 in the centrifugal fan A, a rear end side, i.e., a width of a discharge side of the air F (an extending width w2 from the leading edge 2*e* to the trailing edge 2*c* on the surface perpendicular to the central axis of rotation L), is gradually increased relative to a tip side, i.e., the intake side of the air F.

Figure 3A:
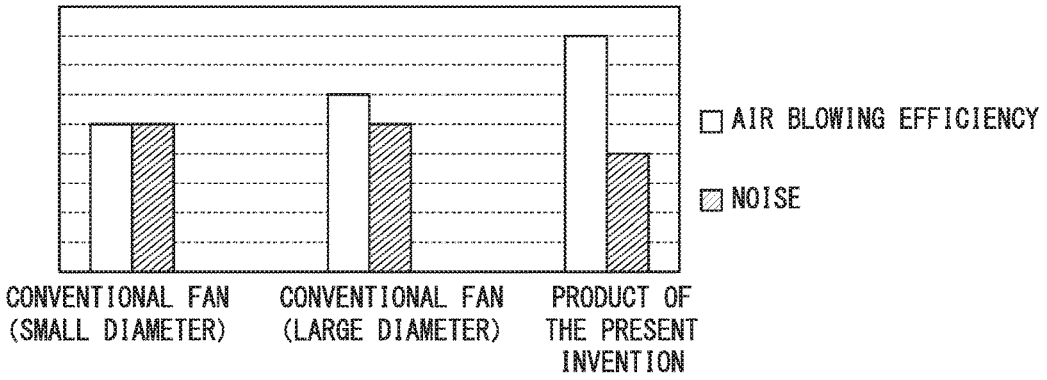
FIG. 3A is a characteristic diagram showing performance of the centrifugal fan A and a bar graph obtained by comparing noise and air blowing efficiency with those of the conventional fan.

According to the centrifugal fan A with the above constitution, for example, when an extending length of the blade tip 2*h* of each of the blades 2 is set to the same dimension as the conventional blade, the extending width w2 of each portion extending over the blade rear end 2*i* from the blade tip 2*h* of each of the blades 2 is gradually increased toward the blade rear end 2*i* compared with the conventional blade. As a result, as shown in FIG. 3A, operational sound (noise) occurring when the air F collides with the blade tips 2*h* of the blades 2 can be reduced by about 1 dB compared with the related art, and air blowing efficiency can be improved by about 2 to 3% compared with the related art. Note that one step on the vertical axis in the characteristic diagram of FIG. 3A indicates 1% with respect to air blowing efficiency (efficiency) and 1 dB with respect to operational sound (noise).

Figure 3B:
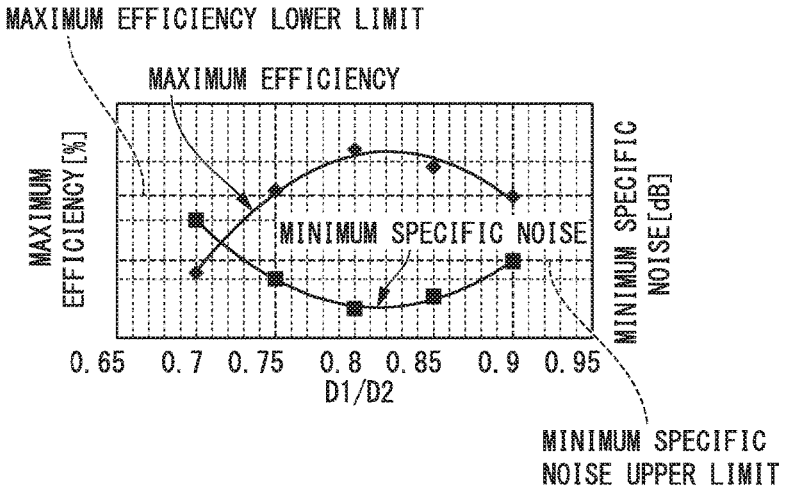
FIG. 3B is a characteristic diagram showing the performance of the centrifugal fan A and a graph showing an influence of a ratio (D1/D2) on noise and air blowing efficiency.
Figure 3C:
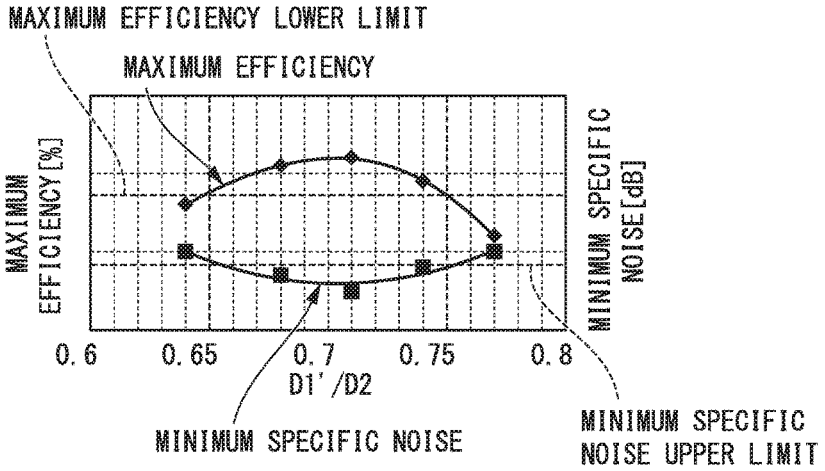
FIG. 3C is a characteristic diagram showing the performance of the centrifugal fan A and a graph showing an influence of a ratio (D1'/D2) on noise and air blowing efficiency.

According to the centrifugal fan A, since the tip leading edge diameter D1 and the rear end leading edge diameter D1' are set to satisfy the above-described relational expressions (3) and (4), improvement of air blowing efficiency and a decrease of operational sound can be optimized. Operational sound (noise) and air blowing efficiency exhibit a diametrical increase or decrease tendency with respect to the ratio (D1/D2) or the ratio (D1'/D2) as shown in FIGS. 3B and 3C. In other words, the operational sound (noise) exhibits an increase or decrease tendency transferred from a decrease to an increase with respect to the ratio (D1/D2) or the ratio (D1'/D2), but the air blowing efficiency exhibits an increase or decrease tendency transferred from an increase to a decrease with respect to the ratio (D1/D2) or the ratio (D1'/D2).

Therefore, the ratio (D1/D2) and the ratio (D1'/D2) are set to ranges indicated by the relational equations (3) and (4), i.e., a relationship of the tip leading edge diameter D1 and the rear end leading edge diameter D1' are set to the ranges indicated by the relational equations (3) and (4) so that the air blowing efficiency can be improved to a greater level while the operational sound (noise) is suppressed to a lesser level as shown in FIGS. 3B and 3C. Note that one step on the vertical axes in the characteristic diagrams of FIGS. 3B and 3C indicates 1% with respect to "maximum efficiency" representing a ratio of air blowing efficiency to a predetermined reference value (the air blowing efficiency of a conventional product) and 1 dB with respect to "minimum specific noise" representing a ratio of operational sound (noise) to a predetermined reference value (the operational sound of a conventional product).

Figure 5:
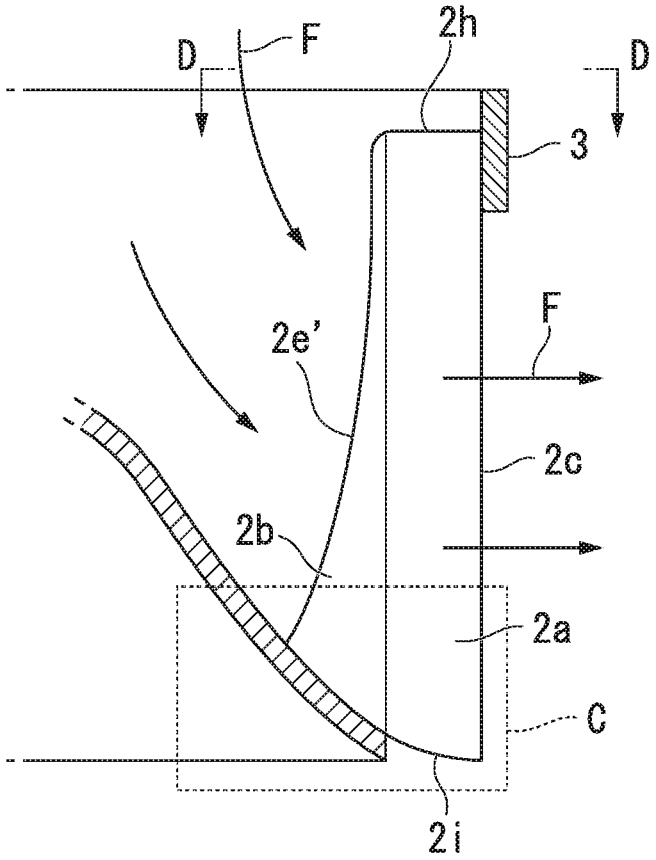
FIG. 5 is a view showing another modified example of the centrifugal fan A, showing an enlarged cross-sectional view of a portion corresponding to a portion Z of FIG. 1B.

According to the centrifugal fan A, the leading edge 2*e* of each of the blades 2 has an inclined linear shape. In other words, the extending width w2 from the leading edge 2*e* to the trailing edge 2*c* on the surface perpendicular to the central axis of rotation L is linearly increased. Thus, the operational sound can be effectively reduced compared with, for example, when the extending width w2 is increased stepwise. Note that a shape of the leading edge 2*e* configured to effectively reduce the operational sound is not limited to only a linear shape, but a constitution in which the leading edge 2*e* of the auxiliary wing section 2*b* when viewed from the side has a curved shape from the intake side in the direction of the central axis of rotation L toward the support section 1 can also be adopted. For example, as shown in FIG. 5, a leading edge 2*e'* of a curved shape recessed gently in the suction direction of the air F can be adopted.

Figure 3D:
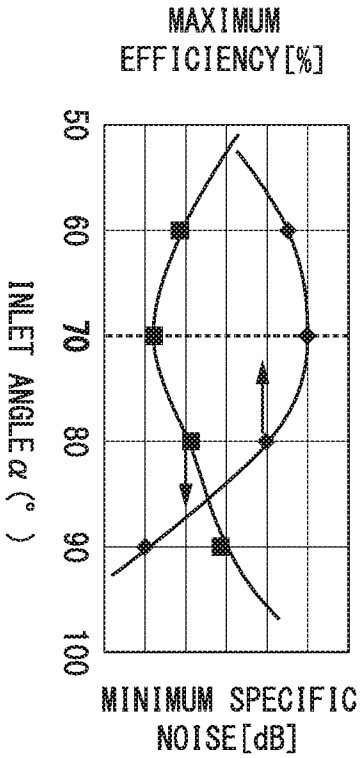
FIG. 3D is a characteristic diagram showing the performance of the centrifugal fan A and a graph showing an influence of an inlet angle α on noise and air blowing efficiency.

According to the centrifugal fan A, since the inlet angle α of each of the blades 2 is set to the angle of 65° or more and 75° or less, the maximum efficiency (the air blowing efficiency) can be improved to a greater level while the minimum specific noise (the operational sound) is suppressed to a lesser level as shown in FIG. 3D. Also, according to the centrifugal fan A, since the exit angle β is set to the angle of 15° or less, the maximum efficiency (the air blowing efficiency) can be improved to a greater level while the minimum specific noise (the operational sound) is suppressed to a lesser level as shown in FIG. 3E.

In other words, the inlet angle α and the exit angle β are set to the above-described ranges so that the occurrence of vortexes or the occurrence of separation of the air F from the surfaces of the blades 2 in the air F flowing between the blades 2 can be suppressed to the minimum. Thus, the noise caused by the vortexes or the separation of the air F from the blades 2 can be reduced. The energy loss caused by the vortexes or the separation of the air F from the blades 2 can also be suppressed to the minimum to improve the air blowing efficiency.

Figure 3E:
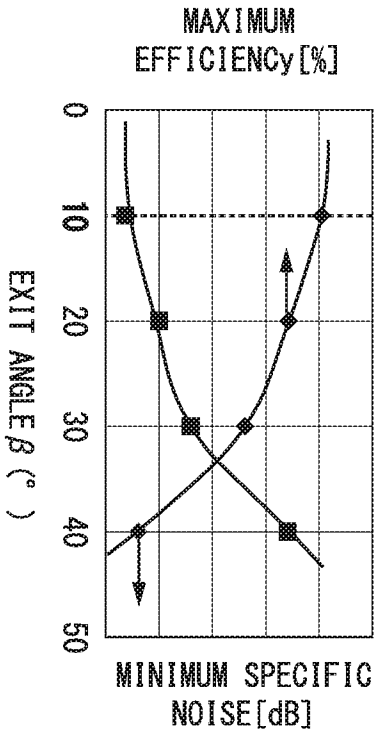
FIG. 3E is a characteristic diagram showing the performance of the centrifugal fan A and a graph showing an influence of an exit angle β on noise and air blowing efficiency.

Note that one step on the vertical axes in the characteristic diagrams of FIGS. 3D and 3E indicates 0.5% with respect to "maximum efficiency" representing a ratio of air blowing efficiency to a predetermined reference value and 0.5 dB with respect to "minimum specific noise" representing a ratio of operational sound (noise) to a predetermined reference value.

Note that the present invention is not limited to only the embodiment, and for example, the following modified examples are considered.

(1) The centrifugal fan A having the support section 1, the plurality of blades 2, the shroud 3, and the mounting section 4 as the main constituent elements has been described in the embodiment, but the present invention is not limited to only this constitution. Since the shape of the blades 2 have the long shapes extending in the direction which is parallel to the central axis of rotation L in the centrifugal fan A, the shroud 3 is provided at upper ends of the blades 2 to more firmly support the blades 2, but the shroud 3 can be omitted when the shapes of the blades 2 are different from those of the embodiment (e.g., when a length thereof is short).

Figure 4:
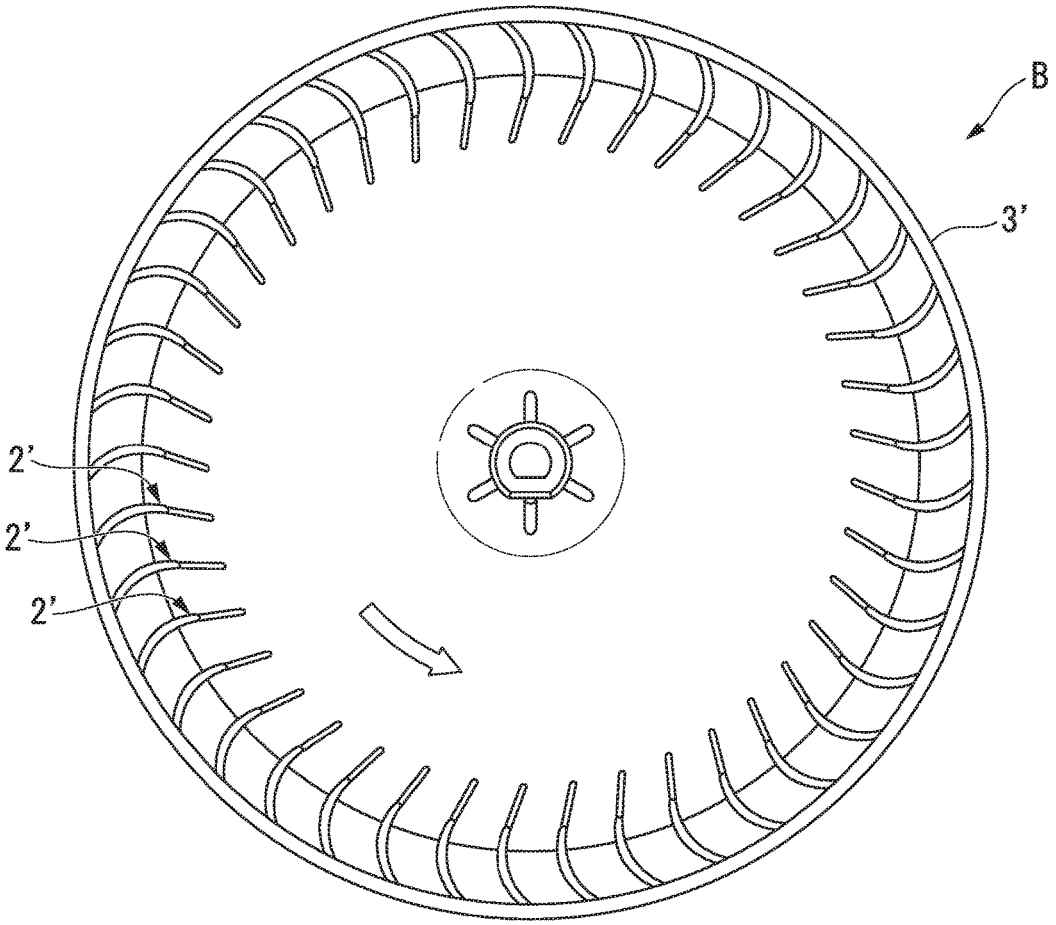
FIG. 4 is a view showing a centrifugal fan B which is a modified example of the centrifugal fan A, showing a front view corresponding to FIG. 1A.

(2) The centrifugal fan A including the shroud 3 having a shape in which the inflow area of the air F is slightly narrowed compared with the circular area defined by the trailing edge diameter D2 has been described in the embodiment, but the present invention is not limited to only this constitution. For example, as shown in FIG. 4, a centrifugal fan B including an annular shroud 3' provided to connect trailing edges of the blades 2' at a blade tip side of the blades 2' may be adopted. The inflow area of the air is set to be substantially the same as the circular area defined by a trailing edge diameter in the shroud 3'. In other words, recessions are provided at the upper portions of the blades 2 shown in FIG. 1B, and the annular shroud 3 that is narrowed to come into close contact with the recessions is integrally provided in the embodiment, but the blades 2' without the recessions are provided and the annular shroud 3' which is not narrowed is integrally provided to come into close contact with an upper outer circumferential side of the blades 2' in the modified example of FIG. 4.

The centrifugal fan B including the shroud 3' is adopted to, for example, a relatively small centrifugal fan in which a ratio of a wing length and a trailing edge diameter of each of the blades 2' is set to a much larger value (e.g., 1 or more) than the above-described ratio (H/D2) of the centrifugal fan A.

Figure 6:
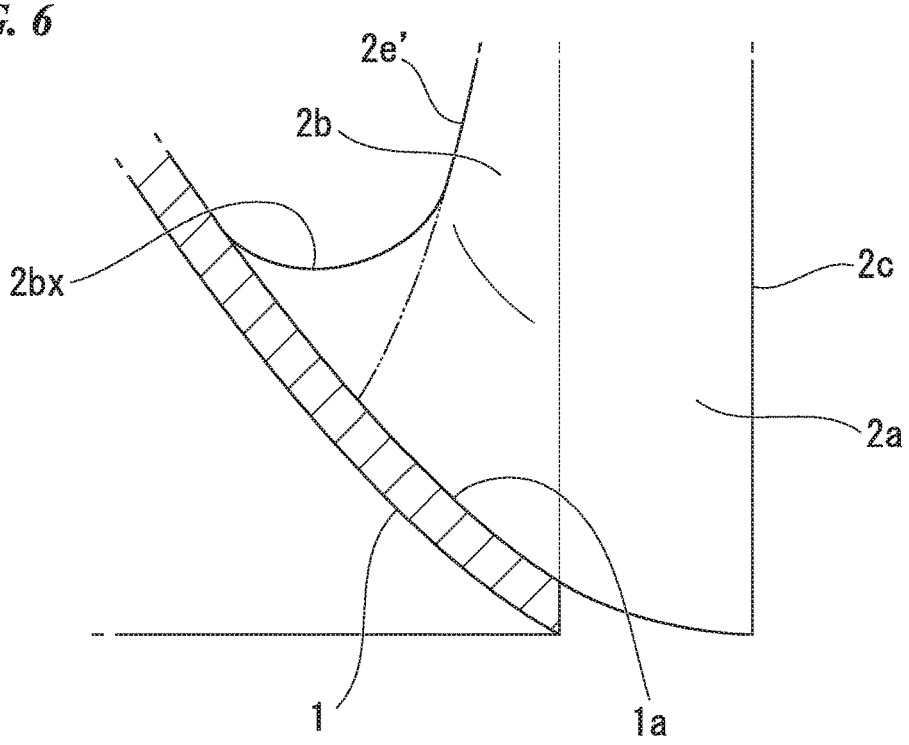
FIG. 6 is a view showing yet another modified example of the aspect shown in FIG. 5, showing a partially enlarged view corresponding to a portion C of FIG. 5.
Figure 7:
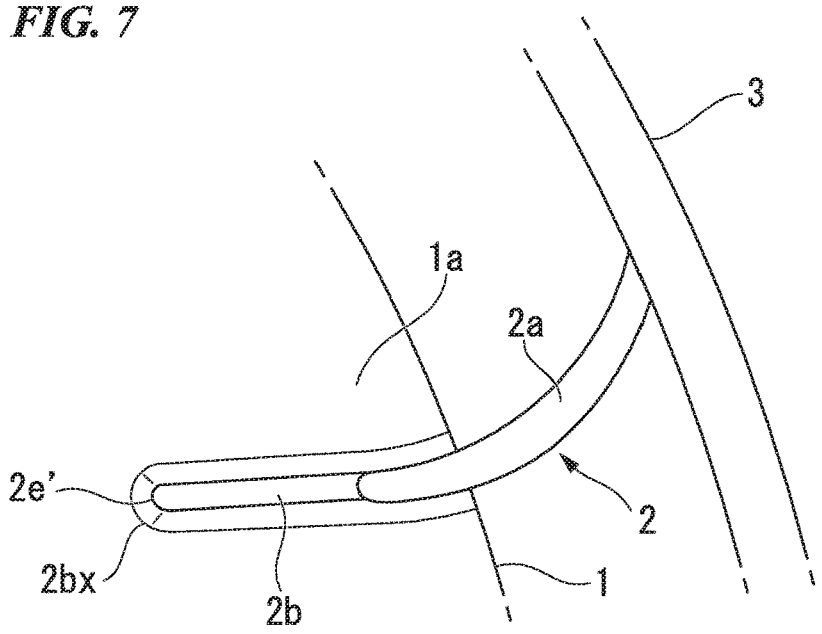
FIG. 7 is a partial plan view of FIG. 6 taken along an arrow D-D of FIG. 5.

(3) The thickness of the auxiliary wing section 2*b* is set to a constant dimension across the entire area thereof in the embodiment and the modified examples, but is not limited to only this constitution. In addition, for example, a thickened reinforced section may be provided at a thickness of a root portion 2*bx* of the auxiliary wing section 2*b* as shown in FIGS. 6 and 7. In other words, the reinforced section in which the thickness of the root portion 2*bx* of the auxiliary wing section 2*b* which is a connected portion to the support section 1 is gradually increased to widen toward the end toward the guide surface 1*a* may be formed. When this reinforced section is provided at the root portion 2*bx* of the auxiliary wing section 2*b*, fixing strength of the blades 2 (2') to the support section 1 can be increased. Also, the mold used for injection molding of the centrifugal fan A (B) is easily manufactured, and it can also contribute to lower costs.

INDUSTRIAL APPLICABILITY

According to the present invention, a centrifugal fan in which air blowing efficiency can be improved while an increase of operational sound is suppressed can be provided.

REFERENCE SIGNS LIST

A, B Centrifugal fan
1 Support section
1*a* Guide surface
2 Blade
2*a* Primary wing section
2*b* Auxiliary wing section
2*c* Trailing edge
2*d* Leading edge end section
2*e* Leading edge
2*f* Pressure surface
2*g* Suction surface
2*h* Blade tips
2*i* Blade rear end
3 Shroud
4 Mounting section
4*a* Mounting hole
D1 Tip leading edge diameter
D1' Rear end leading edge diameter
D2 Trailing edge diameter
H Blade length
L Central axis of rotation
S Rotation shaft

The invention claimed is:

1. A centrifugal fan in which a rotation shaft is attached to a mounting section to rotate in a predetermined direction so that air taken in from a front of a support section is blown out radially, the centrifugal fan comprising:

the support section having a circular shape viewed from the front;

a plurality of blades arranged in an annular shape along an outer circumference of the support section; and the mounting section provided at a center of the support section, wherein each of the blades includes:

a primary wing section that has a trailing edge which is parallel to a central axis of rotation of the rotation shaft, a leading edge end section which is parallel to the central axis of rotation, and a thickness gradually growing thinner toward the trailing edge and the leading edge end section; and an auxiliary wing section that extends from the leading edge end section of the primary wing section toward the interior of the centrifugal fan, and wherein the auxiliary wing section has a length from the leading edge end section of the primary wing section to a leading edge of the auxiliary wing section that is greater at a side of the support section than at an intake side when viewed in a direction of the central axis of rotation, and wherein the auxiliary wing section has a constant thickness across the entire area of the auxiliary wing section.

2. The centrifugal fan according to claim 1, wherein a pressure surface of the auxiliary wing section and a pressure surface of the primary wing section are smoothly connected to each other.

3. The centrifugal fan according to claim 2, wherein the auxiliary wing section extends in a tangential direction at a position of the leading edge end section on the pressure surface of the primary wing section.

4. The centrifugal fan according to claim 1, wherein the auxiliary wing section when viewed from the front is linearly formed from the leading edge end section of the primary wing section to the leading edge of the auxiliary wing section.

5. The centrifugal fan according to claim 1, wherein the leading edge of the auxiliary wing section when viewed from the side has a linear shape from the intake side in the direction of the central axis of rotation toward the side of the support section.

6. The centrifugal fan according to claim 5, wherein D1/D2 which is a ratio obtained by dividing an intake-side leading edge diameter D1 which is defined by the leading edge at the linear portion of each of the blades and is a diameter at the position of the intake side in the direction of the central axis of rotation by a trailing edge diameter D2 which is a diameter defined by the trailing edge of each of the blades satisfies the following relational equation (1), and D1'/D2 which is a ratio obtained by dividing a support section-side leading edge diameter D1' which is defined by the leading edge at the linear portion of each of the blades and is a diameter at a position of the side of the support section in the direction of the central axis of rotation by the trailing edge diameter D2 satisfies the following relational equation (2):

$$0.75 \leq D1/D2 \leq 0.90 \quad (1) \text{ and}$$

$$0.65 \leq D1'/D2 \leq 0.75 \quad (2)$$

7. The centrifugal fan according to claim 1, wherein an angle formed by a tangent at the leading edge end section of an inscribed circle of the leading edge end section and a tangent at the leading edge end section of the pressure surface of the primary wing section is 65° or more and 75° or less, and an angle formed by a tangent at the trailing edge of a circumscribed circle of the trailing edge and a tangent at the trailing edge of the pressure surface of the primary wing section is 0° or more and 15° or less.

8. The centrifugal fan according to claim 1, wherein the leading edge of the auxiliary wing section when viewed from the side has a curved shape from the intake side in the direction of the central axis of rotation toward the support section.

9. The centrifugal fan according to claim 1, further comprising:

an annular shroud configured to fix the trailing edges of the blades at tip sides of the blades.

* * * * *